US006739427B2

(12) United States Patent
Gayetty

(10) Patent No.: US 6,739,427 B2
(45) Date of Patent: May 25, 2004

(54) SAFETY HARNESS

(75) Inventor: Joseph F. Gayetty, Franklin, PA (US)

(73) Assignee: Bacou-Dalloz Fall Protection Investment, Inc., Wilmington, DE (US)

( * ) Notice: Subject to any disclaimer, the term of this patent is extended or adjusted under 35 U.S.C. 154(b) by 0 days.

(21) Appl. No.: 09/775,740

(22) Filed: Feb. 2, 2001

(65) Prior Publication Data

US 2003/0010567 A1 Jan. 16, 2003

(51) Int. Cl.[7] ..... A47L 3/04
(52) U.S. Cl. ..... 182/3; 182/7
(58) Field of Search ..... 182/3, 6; 119/857; 244/151 R; 139/383 R, 421

(56) References Cited

U.S. PATENT DOCUMENTS

| | | | | | |
|---|---|---|---|---|---|
| 3,805,848 | A | * | 4/1974 | Chrow | 138/137 |
| 4,034,547 | A | * | 7/1977 | Loos | 57/146 |
| 4,147,406 | A | * | 4/1979 | Anderson | 350/96.23 |
| 4,228,824 | A | * | 10/1980 | Evans et al. | 138/119 |
| 4,278,726 | A | * | 7/1981 | Wieme | 428/229 |
| 4,298,648 | A | | 11/1981 | Turnbull | |
| 4,640,178 | A | * | 2/1987 | Kurzbock | 87/6 |
| 4,679,267 | A | * | 7/1987 | Thiele | 5/494 |
| 4,852,874 | A | * | 8/1989 | Sleichter, III et al. | 272/137 |
| 4,878,606 | A | * | 11/1989 | Miller | 224/208 |
| 5,050,704 | A | | 9/1991 | Olsson | |
| 5,197,370 | A | * | 3/1993 | Gladfelter | 87/7 |
| 5,436,044 | A | | 7/1995 | Pinkos | |
| 5,564,476 | A | | 10/1996 | Golz | |
| 5,857,540 | A | * | 1/1999 | Sadeck | 182/6 |
| 6,006,700 | A | * | 12/1999 | Cox | 119/857 |
| 6,035,440 | A | * | 3/2000 | Woodyard | 2/102 |
| 6,057,252 | A | | 5/2000 | Tang et al. | |
| 6,239,374 | B1 | * | 5/2001 | Kastner | 174/84 R |
| 6,463,593 | B2 | * | 10/2002 | Cotten | 2/227 |

FOREIGN PATENT DOCUMENTS

WO WO 02/060536 * 8/2002

* cited by examiner

*Primary Examiner*—Bruce A. Lev
(74) *Attorney, Agent, or Firm*—Bartony & Hare, LLP

(57) ABSTRACT

A safety harness to be worn by a person includes a strap portion for extending over a portion of the person's body to retain the person within the safety harness. At least a section of the strap portion includes an outer shell of a high strength, flexible material. The outer shell has a channel therein. The outer shell can, for example, have a tubular construction. The strap portion further includes a flexible inner member within the channel of the outer shell. The flexible inner member generally prevents the lateral edges of the strap portion from forming a sharp edge when under tension. In that regard, the lateral edges of the strap portion preferably remain blunted, arced or rounded rather than forming a sharp edge when the strap portion is under tension forces experienced in normal use of the safety harness. The rounded or blunted lateral edges of the strap portion reduce or eliminate the binding, pinching and chaffing common with currently available safety harnesses.

23 Claims, 13 Drawing Sheets

200
250
300
200a
250a
300a
200b
250b
300b
200c
250c
300c
260c
300c'

SAFETY HARNESS

BACKGROUND OF THE INVENTION

The present invention relates to a safety harness and, more particularly, to a safety harness to be worn by a person to protect that person from injury in case of a fall.

Safety harnesses are commonly used as part of a fall protection system for persons subjected to the potential of a fall from a height. In the workplace, full-body safety harnesses are generally used. Such harnesses, which typically include both an upper torso portion (having, for example, shoulder straps) and a lower torso portion (having, for example seat straps and leg straps), can be designed in many alternative manners.

Most currently available full-body safety harnesses are manufactured from relatively inelastic, woven webbing materials such as nylon or polyester. A portion of a harness strap 1 including such a webbing material 2 is illustrated in FIGS. 1A through 1C. Although the strength of such materials is well suited for fall protection, harnesses fabricated from such materials cause discomfort for the user by, for example, impairing movement of the worker and digging into the worker's body at the lateral edges of the straps. In that regard, inelastic webbing material 2 limits the range of motion of the user and has relatively thin, sharp lateral edges 3 and 5 that displace the user's skin and dig into the user's body when under even relatively low tension forces experienced in normal use of a safety harness. The resultant discomfort, reduces effectiveness of the worker and causes relatively quick fatigue. The limited range of motion, discomfort and fatigue associated with current safety harnesses can result in safety lapses by the worker.

Recently, a flexible and elastic harness, as described in U.S. Pat. No. 6,006,700, the disclosure of which is incorporated herein by reference, has been introduced that greatly improves the comfort of the user.

Nonetheless, it remains desirable to develop safety harnesses resulting in improved user comfort and improved overall safety.

SUMMARY OF THE INVENTION

The present invention provides a safety harness to be worn by a person including a strap portion for extending over a portion of the person's body to retain the person within the safety harness. The lateral edges of the strap portion preferably remain, for example, relatively thick as well as blunted, arced or rounded rather than forming a thin or sharp edge in contact with the user's body when the strap portion is under tension forces experienced in normal use of the safety harness (that is, use of the safety harness in situations other than a fall). In that regard, the lateral edges of the strap portion in contact with the user's body preferably remain relatively thick as well as blunted, arced or rounded under tension forces of up to approximately 100 pound. More preferably, the lateral edges of the strap portion remain relatively thick as well as blunted, arced or rounded under tension forces of up to approximately 150 pounds. Most preferably, the lateral edges of the strap portion remain relatively thick as well as blunted, arced or rounded under tension forces of up to approximately 200 pounds.

The relatively thick, arced, rounded or blunted lateral edges of the strap portion of the present invention do not "dig into" the body of the user during use of the safety harness and reduce or eliminate the binding, pinching and chaffing common with the relatively thin, "sharp" lateral edges of currently available safety harnesses.

In one embodiment of a safety harness of the present invention, at least a section of the strap portion includes an outer shell of a high strength, flexible material. The outer shell has a channel therein. The outer shell can, for example, have a tubular construction. The strap portion further includes a flexible inner member within the channel of the outer shell. The flexible inner member generally prevents the lateral edges of the strap portion from forming a thin, sharp edge (as discussed above) when under tension.

The flexibility of the inner member is preferably limited such that the inner member retains its shape sufficiently to prevent tangling of the strap portion when not in use.

In one embodiment, the inner member is elastic and the length of the tubular outer shell is sufficiently long to allow extension of the strap portion. The outer shell preferably has an ultimate tensile of at least 4000 pounds. In another embodiment, the inner member is elastic and the outer member is fabricated from a high strength, elastic material. In that embodiment, the material of the outer shell preferably has an ultimate tensile of at least 4000 pounds and exhibits an elastic extension of at least approximately 3% under a tensile load of approximately 20 pounds. As appreciated by one skilled in the art, however, neither the inner member or the outer shell is required to be elastic.

The inner member is preferably adapted to maintain the thickness of the strap portion of the present invention (particularly in the region of the lateral edges thereof) in a range of approximately 0.25 inches to 0.5 inches. To further improve comfort of the safety harness of the present invention, the inner member is preferably compressible, yet maintains the thickness of the strap portion in the range discussed above. In that regard, the inner member preferably exhibits a compression of approximately 25% at an applied pressure in the range of approximately 4 to approximately 10 $lb/in^2$. The inner member also preferably exhibits a compression of approximately 50% at an applied pressure in the range of approximately 8 to approximately 20 $lb/in^2$.

A minimum stiffness for the material of the inner member can be defined such that the inner member deflects no more than approximately 0.75 inches when extended over an edge to a distance of approximately 1 inch past the edge and placed under a load of approximately 2 ounces. A maximum stiffness for the material of the inner member can be defined such that the inner member deflects no more than approximately 0.75 inches when extended over an edge to a distance of approximately 4 inch past the edge and placed under a load of approximately 2 ounces.

The present invention also provided a safety harness to be worn by a person including a strap portion for extending over a portion of the person's body to retain the person within the safety harness. At least a section of the strap portion includes an outer shell of a high strength, flexible material and a flexible inner member. The flexibility of the inner member is preferably such that the inner member does not substantially interfere with motion of the person when the safety harness is in use but that the strap portion generally retains its shape when the safety harness is not in use.

The present invention also provides a method of manufacturing a strap for a safety harness for extending over a portion of the person's body to retain the person within the safety harness. The method preferably includes the steps of providing an outer shell of high strength, flexible material having an inner channel, and placing a flexible inner member within the inner channel of an outer shell of the high strength, flexible material. The flexible inner member generally prevents the lateral edges of the strap portion from forming a thin, sharp edge when under tension as discussed above. As also discussed above, the flexibility of the inner member is preferably such that the inner member does not substantially interfere with motion of the person when the safety harness is in use but that the strap portion generally retains its shape when the safety harness is not in use.

DETAILED DESCRIPTION OF THE INVENTION

Figure 1A:
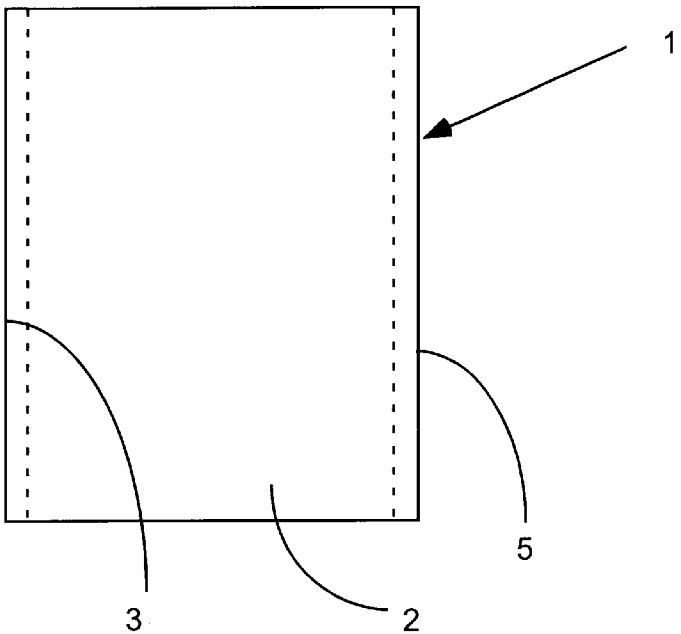
Figure 1A PRIOR ART
FIG. 1A illustrates a top, plan view of a portion of a strap of a safety harness fabricated from an inelastic webbing material.
Figure 1B:
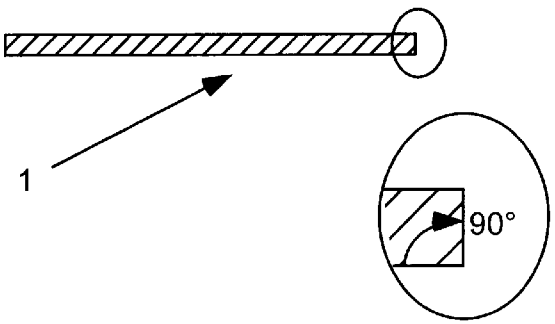
Figure 1B PRIOR ART
FIG. 1B illustrates a front, cross-sectional view of the webbing material of FIG. 1A.
Figure 1C:
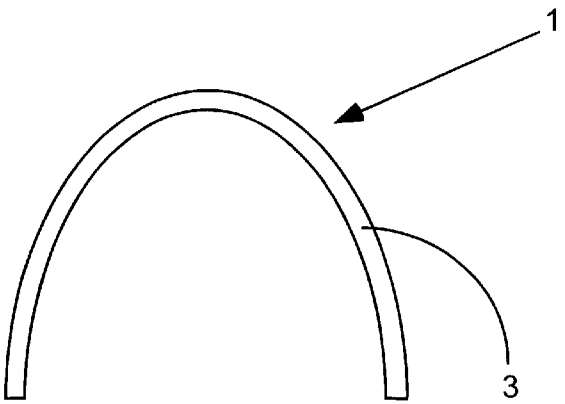
Figure 1C PRIOR ART
FIG. 1C illustrates a side view of the webbing material of FIG. 1A in a flexed or curved state.
Figure 2:
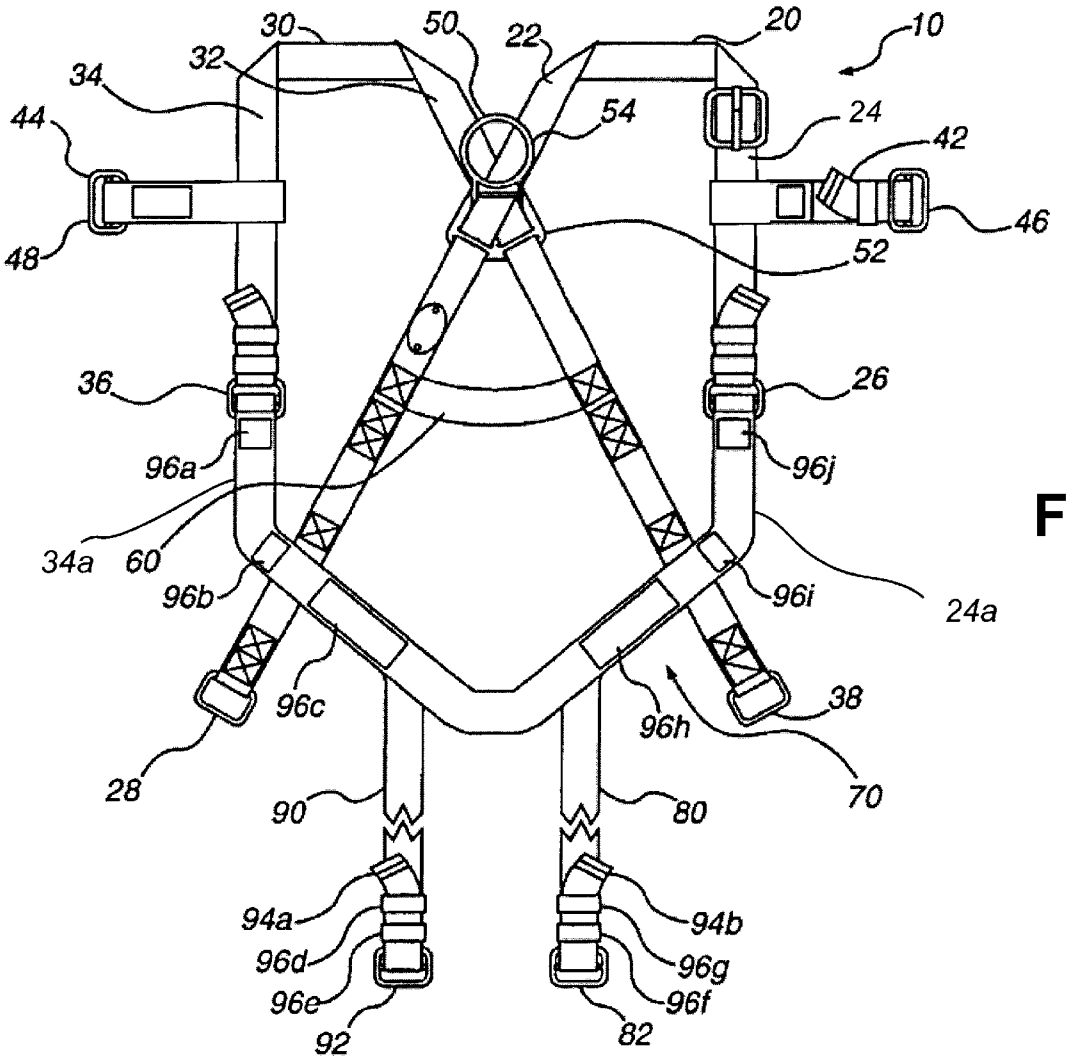
FIG. 2 illustrates a rear view of an embodiment of a full-body harness under the present invention.

Referring to FIG. 2, an embodiment of a full-body safety harness 10 of the present invention is discussed below. The overall structural design of safety harness 10 corresponds generally, for example, to the Model 650 safety harness available from Dalloz Fall Protection, Inc. of Franklin, Pa. Safety harness 10 includes an upper torso portion comprising first and second shoulder straps 20 and 30 for extending over the shoulders of the user and a chest strap 40 (see FIG. 3) for extending over a portion of the chest of the user.

Figure 4:
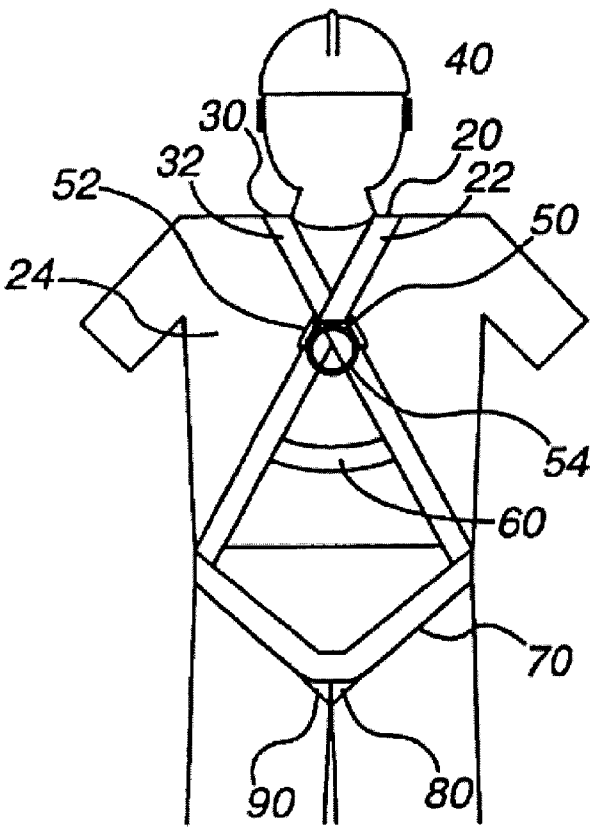
FIG. 4 illustrates a rear view of a person wearing the safety harness of FIG. 2.

As illustrated in FIG. 4 a first end of each of shoulder straps 20 and 30 extends down over the back of the user to form first and second generally longitudinal back straps 22 and 32, respectively. Longitudinal back straps 22 and 32 of shoulder straps 20 and 30 cross through and connect to a typical D-ring 50 as known in the art. D-ring 50 includes a harness connection portion 52 and an anchor portion 54. Harness connection portion 52 enables fastening of D-ring 50 to safety harness 10 via longitudinal back straps 22 and 32. Anchor portion 54 is adapted to be connected to a nylon rope, a chain, webbing or other connector which may be used to anchor the person wearing safety harness 10.

In the embodiment of FIG. 2, after crossing and passing through D-ring 50, shoulder straps 20 and 30 are connected via a generally latitudinal back strap 60. As illustrated in FIG. 4, latitudinal back strap 60 passes generally latitudinally over a portion of the back of the user.

Figure 3:
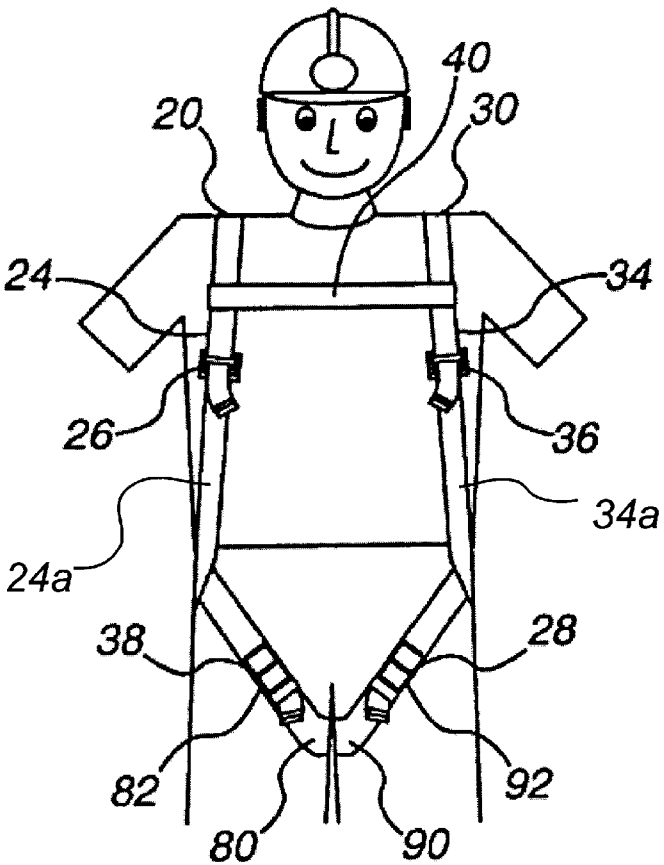
FIG. 3 illustrates a front view of a person wearing the safety harness of FIG. 2.

A second end of each of shoulder straps 20 and 30 extends downward over the front of the user as illustrated in FIG. 3 to from generally longitudinal first and second front straps 24 and 34, respectively. A first chest strap portion 42 is preferably attached to front strap 24 and a second chest strap portion 44 is attached to front strap 34. Each of first and second chest straps 42 and 44 have cooperating fastening members 46 and 48 on the ends thereof to enable attachment of first and second chest straps 42 and 44 to form chest strap 40. As known in the art, first and second chest straps 42 and 44, respectively, are preferably attached via an adjustable mating buckle mechanism, including, for example, cooperating fastening members 46 and 48.

First and second front straps 24 and 34 extend further downward and preferably include adjustment members 26 and 36 (for example, adjustable buckles) as known in the art for adjustment of the fit of safety harness 10 on the upper torso of the user. Extending still further downward as illustrated in FIG. 2, extensions 24*a* and 34*a* of first and second front straps 24 and 34 converge and meet generally centrally to form a seat portion or sub-pelvic portion 70. As illustrated in FIGS. 2 and 3, first and second front extension straps 24*a* and 34*a* pass to the rear of the user and seat portion 70 passes under the seat of the user.

Attached to and extending from seat portion 70 are a first and a second leg strap 80 and 90, respectively. Each of first and second leg straps 80 and 90 pass around the upper leg of the user to be attached to the distal end of first and second longitudinal back straps 22 and 32, respectively. The distal ends of each of first and second leg straps 80 and 90 and the distal ends of each of longitudinal back straps 22 and 32 thus preferably comprise cooperating fastening members (82 and 92 and 28 and 38, respectively) such as adjusting buckle members as known in the art.

In the design of FIG. 2, the bottom portion of safety harness 10 can, for example, be fabricated from a single, integral length of material. In that regard, the length of material as described above begins at first end 94*a* on leg strap 90. The material the travels downward through fastening member 92 and then travels upward toward seat portion 70, thereby forming leg strap 90. Upon reaching seat portion 70, the material travels along the path identified by the left side of seat portion 70, forming the back side thereof. The material travels to adjustment member 36 at which point it is preferably looped around or through adjustment member 36. The material then travels downward (doubling itself) over the lower portion of longitudinal front strap 34 and the left side of seat portion 70. The material the travels across the center of seat portion 70 and upward along the path defined by the right side of seat portion 70. Upon reaching adjustment member 26, the material is preferably looped around or through adjustment member 26. After looping through adjustment member 26, the material travels downward (doubling itself) under the lower portion of longitudinal front strap 24 and the right side of seat portion 70. Before reaching the center of seat portion 70, the material breaks away from the path of seat portion 70 to extend downward to from leg strap 80. The material preferably loops through fastening member 82 and terminates at second end 94*b*. Over those areas of doubling, the material is preferably held together via, for example, several stitching areas (96*a*–96*j*).

Preferably, at least a portion of shoulder straps 20 and 30 (including, longitudinal back straps 22 and 32 and first and second front straps 24 and 34) are formed so that the lateral edges thereof are not thin or sharply angled. Preferably, the lateral edges of the strap portions are sufficiently thick and sufficiently arced, rounded or blunted in shape to prevent user the discomfort commonly caused by the thin, sharp lateral edges of currently available safety harnesses. Other straps of safety harness 10 (or at least a portion thereof) such as seat portion 70, first leg strap 80 and second leg strap 90 can also be formed so that the lateral edges thereof are, for example, relatively thick as well as arced, rounded and/or blunted in shape as described above. The rounded or blunted shape of the lateral edges of these straps when under tension forces experienced in the normal use of fall protection safety harnesses greatly increases the comfort of safety harness 10. Unlike currently available safety harnesses (see, for example, FIGS. 1A through 1C and FIGS. 7A through 7C), the straps of safety harness 10 do not "dig into" the body of the user during use and thereby greatly reduce or eliminate the binding, pinching and chaffing common with currently available safety harnesses.

In several embodiments of the present invention as illustrated in FIGS. 5A through 6E, at least a portion of one or more of the straps of safety harness 10 includes a strap portion 200 having a generally outer shell 250 of, for example, a webbing material. Outer shell 250 forms a channel or passage therein. Outer shell 250 can, for example, be generally tubular in cross section. Other cross-sectional shapes of outer shell 250 (for example, generally rectangular) are also suitable. Within the inner channel of outer shell 250 is preferably an inner member or filler member 300. Inner member 300 is preferably, sufficiently flexible to allow the user to move within the harness without significant interference with such movement and of suitable physical characteristics (for example, suitable compressibility) to facilitate maintaining a rounded or blunted shape at the lateral edges of strap portion 150 by preventing the lateral edges of outer shell 250 from forming a sharp edge when under tension as described above.

Outer shell 250 is preferably fabricated from a relatively high-strength material that is preferably suitable to withstand any forces experienced in fall protection. In the United States, for example, such materials preferably exhibit an ultimate tensile load of at least approximately 4000 pounds, and, more preferably, at least approximately 4500 pounds. Standard nylon webbing materials (available, for example, from Southern Weaving of Greenville, S.C.) can be used for outer shell 200. Outer shell 250 can, for example, be a tubular or oval-shaped woven material made from synthetic fibers (for example, nylon). A suitable tubular woven material is produced by southern Weaving of Greenville, S.C. under product number 1302. Such tubular woven materials can, for example, have a wall thickness in the range of approximately 0.075 to approximately 0.10 inches and preferably have a width (when flattened) in the range of 1.75 to approximately 2.0 inches.

Figure 5A:
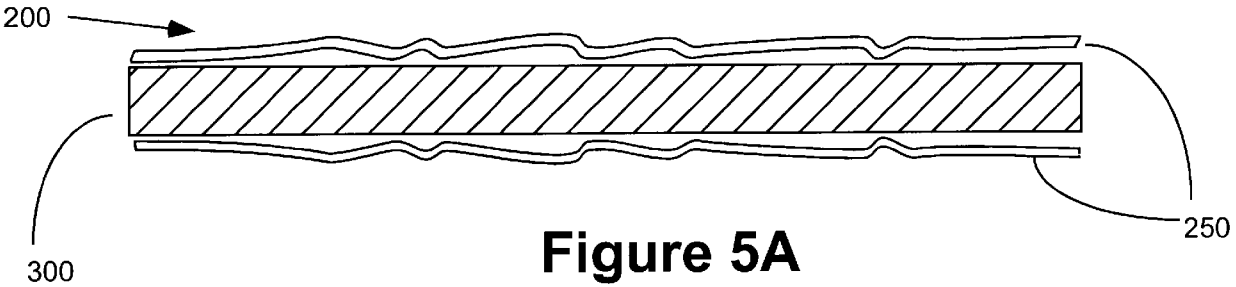
FIG. 5A illustrates a side, cross-sectional view of a strap portion of the harness of FIG. 2.
Figure 5B:
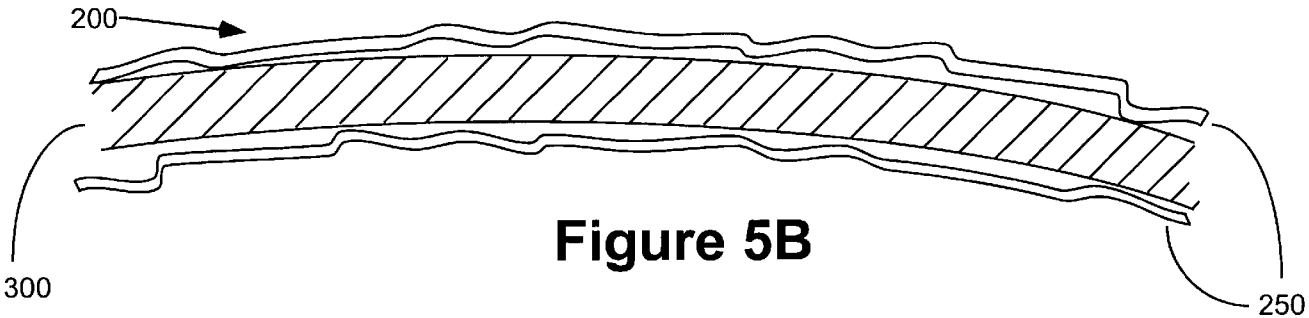
FIG. 5B illustrates a side, cross-sectional view of the strap portion of FIG. 5A in a curved form.
Figure 5C:
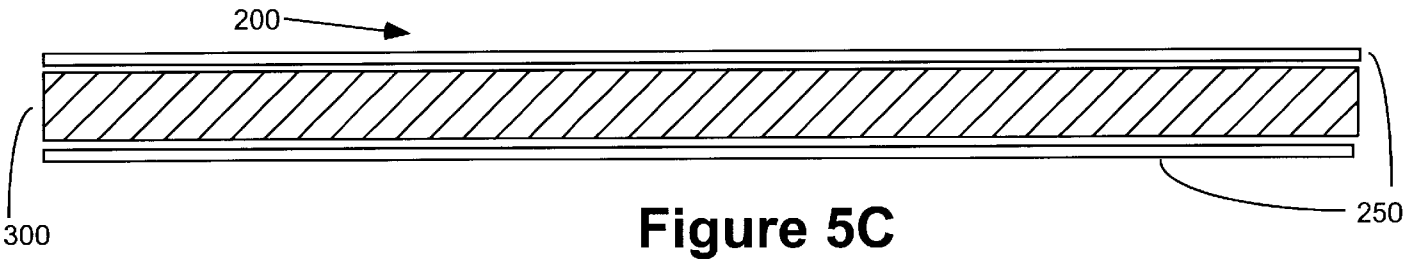
FIG. 5C illustrates a side, cross-sectional view of the strap portion FIG. 5A in a stretched form.

As best illustrated in FIGS. 5A through 5C, in the case that outer shell 250 is formed from a relatively non-elastic material, outer shell 250 can, for example, be provided with extra length such that the material is bunched or folded on itself. Inner member 300 in this embodiment is preferably stretchable or extendible such that strap portion 200 can extend under tension until the point at which outer shell 250 completely unfolds or unbunches and prevents further extension of strap portion 200 as illustrated in FIG. 5C. Inner member 300 need not be fabricated from a material of high ultimate tensile load as any relatively large forces experienced in fall protection are borne by outer shell 250 when extended. The ability of strap portion 250 to extend with movement of the user facilitates mobility of the user. Shell 250 can also be fabricated from a high-strength, elastic material as described in U.S. Pat. No. 6,006,700. In the case that shell 250 is fabricated from a high-strength, elastic material, there is no need to provide extra length thereof to allow bunching or folding as described above.

As set forth in U.S. Pat. No. 6,006,700, such high-strength, elastic strap portions preferably exhibit an elastic extension of at least 3% under a tensile load of approximately 20 pounds, and, more preferably, at a tensile load of approximately 10 pounds, thereby facilitating movement of the person within the safety harness. Preferably, such strap portions are adapted to exhibit an elastic extension in the range of approximately 3% to approximately 20% under a tensile load of approximately 20 pounds, and, more preferably, under a tensile load of approximately 10 pounds. Even more preferably, the elastic extension is in the range of approximately 3% to approximately 15% under such tensile loading. Most preferably, the elastic extension is in the range of approximately 7% to approximately 11% under such tensile loading. Such materials also preferably exhibit an ultimate tensile load of at least approximately 4000 pounds, and, more preferably, at least approximately 4500 pounds.

Figures 6A, 6B, 6C, 6D:
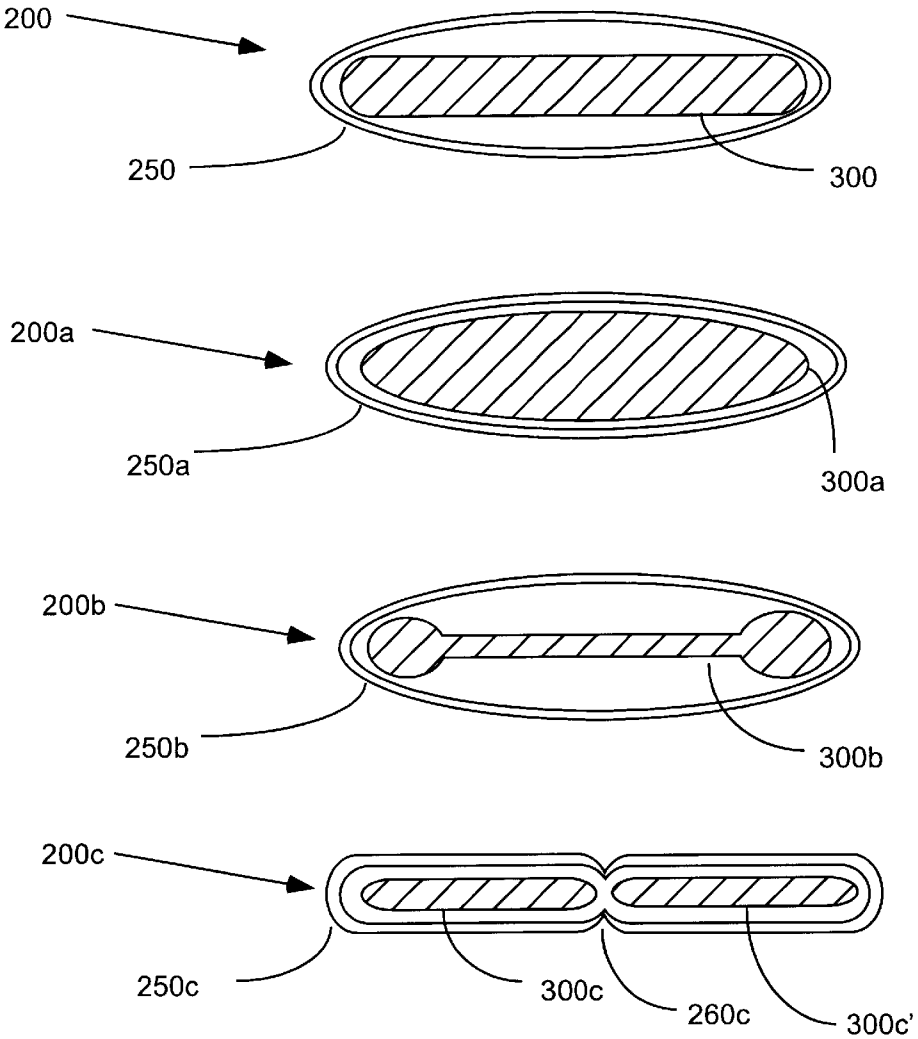
FIGS. 6A illustrates a front, cross-sectional view of the safety harnesses strap portion FIGS. 5A through 5C.
FIGS. 6B through 6E illustrated front, cross-sectional views of several other embodiments of strap portions of safety harnesses of the present invention.
Figure 6E:
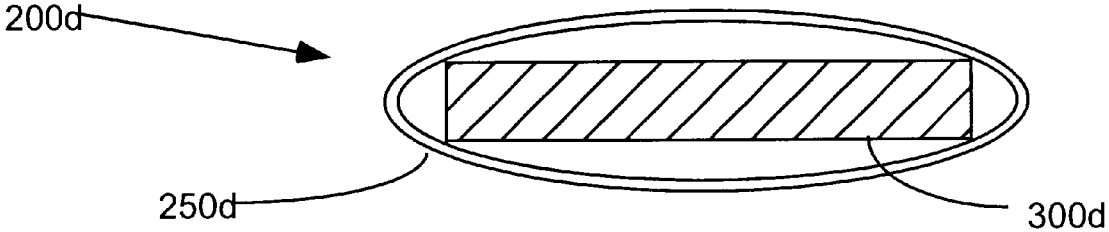

As illustrated in several examples set forth in FIGS. 6A through 6E, the outer shells and filler members of the present invention can take a wide variety of forms. In FIGS. 6A through 6C, filler members 300, 300*a* and 300*b* are integral across the cross section thereof and have generally rounded lateral edges. Filler members 300, 300*a* and 300*b* are encased within generally tubular outer shells 250, 250*a* and 250*b*, respectively. Filler members 300, 300*a* and 300*b* preferably have a width slightly less than the width of outer shells 250, 250*a* and 250*b*, respectively. In FIG. 6D, strap portion 200*c* includes an outer shell 250*c* divided into two sections by a seam 260*d* generally in the center of outer shell 250*c*. Each side of outer shell 250*c* includes a filler member 300*c* and 300*c*', respectively. As with filler members 300, 300*a* and 300*b*, filler members 300*c* and 300*c*' have rounded or blunted lateral edges.

It is not necessary, however, that the filler material have rounded or curved lateral edges. In strap portion 200*d* or FIG. 6E, it is illustrated that even, for example, a filler member 300*d* of rectangular cross section is suitable for use in the present invention.

Figure 7B:
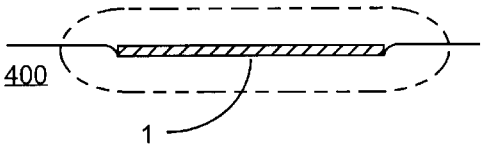
Figure 7B PRIOR ART
FIG. 7B illustrates a front, cross-sectional view of the shoulder strap of FIG. 7A passing over the shoulder of the user while under tension.
Figure 7C:
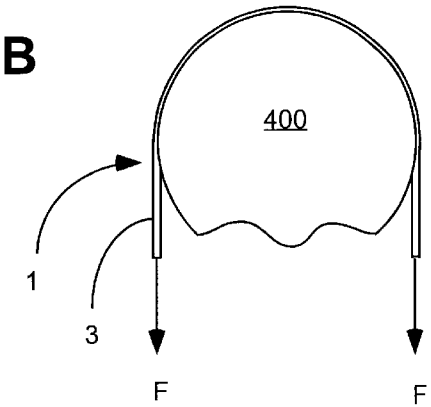
Figure 7C PRIOR ART
FIG. 7C illustrates a side view of the shoulder strap of FIG. 7A passing over the shoulder of the user while under tension.
Figure 7A:
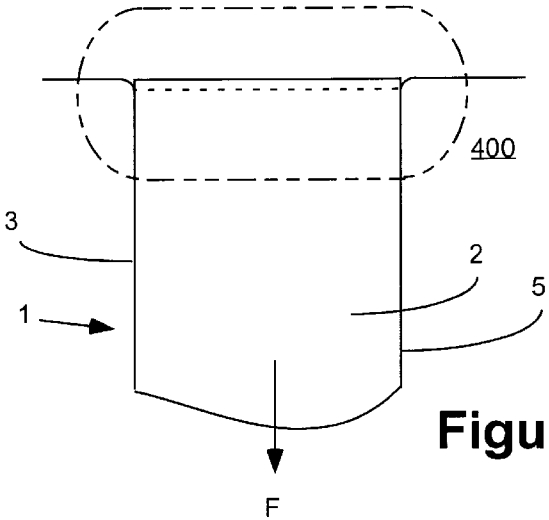
Figure 7A PRIOR ART
FIG. 7A illustrates a front view of a shoulder strap of a currently available safety harness passing over the shoulder of a user while under tension and displacing or digging into the flesh of the user.
Figure 7D:
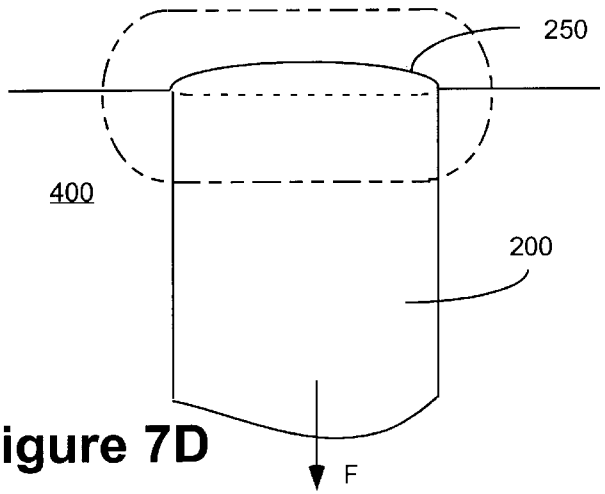
FIG. 7D illustrates a front view of a shoulder strap of one embodiment of a safety harness of the present invention passing over the shoulder of a user while under tension without displacing or digging into the flesh of the user.
Figure 7E:
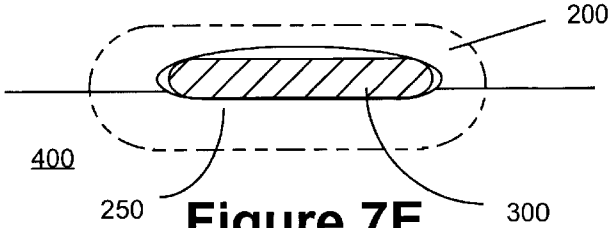
FIG. 7E illustrates a front, cross-sectional view of the shoulder strap of FIG. 7D passing over the shoulder of the user while under tension.
Figure 7F:
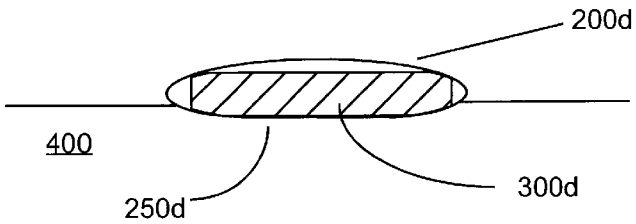
FIG. 7F illustrates a front, cross-sectional view of the shoulder strap another embodiment of a safety harness of the present invention including a filler member of generally rectangular cross section passing over the shoulder of the user while under tension.
Figure 7G:
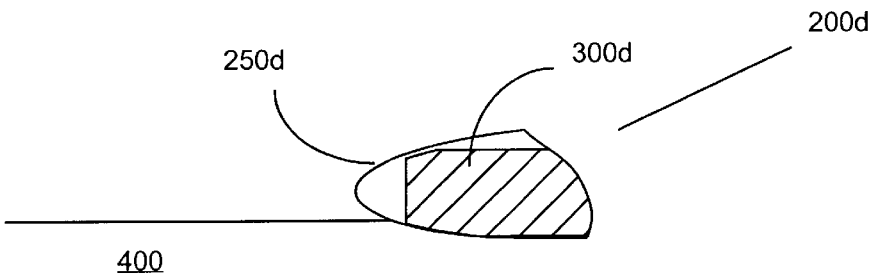
FIG. 7G illustrates an expanded front, cross-sectional view of a portion of the shoulder strap of FIG. 7F passing over the shoulder of the user.

FIGS. 7A through 7C illustrate how currently available safety harness strap 1, including a webbing material 2 with lateral sides 3 and 5, indents or digs into the flesh of, for example, a user's shoulder 400 when under tension force F, causing substantial binding, chaffing and general discomfort to the user. FIGS. 7D through 7G illustrate the use of safety harnesses of the present invention under an tensile force F without the lateral edges of, for example, outer shells 250 and 250*d* of straps 200 and 200*d*, respectively, indenting or digging into the user's shoulder 400.

In general, the combination of an outer shell having a channel (whether, for example, generally oval, generally tubular or generally rectangular in shape) with a filler material therein, results in the surface of the strap portion next to the user's skin to conform generally to the user's body. However, the lateral edges of the strap portion remain relatively thick (compared to conventional flat, webbing harness straps) and are preferably rounded or blunted, allowing the lateral edges of the straps of the present invention ride above the user's flesh/body without binding or chaffing. Moreover, the outer shells of the present invention can be fabricated from materials commonly used in currently available safety harnesses, virtually ensuring compliance with current ultimate tensile load and other standards. Furthermore, the internal filler members of the present invention are easily chosen to add little weight to the safety harness and provide increased comfort and other benefits as described below without adding external features to the harness which can easily wear out or catch onto things during use.

The inner member is preferably adapted to maintain the thickness of the strap portion of the present invention (particularly in the region of the lateral edges thereof) in a range of approximately 0.25 inches to approximately 0.5 inches. The inner member is preferably compressible, yet maintains the thickness of the strap portion in the above range. In general, the inner or filler members of the present invention preferably exhibit a compression between approximately 10 to 40% (more preferably, between approximately 20 and 30%, and, most preferably, approximately 25%) at an applied pressure in the range of approximately 4 to approximately 10 lb/in$^2$. Such materials also preferably exhibit a compression between approximately 30 and 70% (more preferably, between approximately 40 and 60%, and, most preferably, approximately 50%) at an applied pressure in the range of approximately 8 to approximately 20 lb/in$^2$. The material for the inner or filler member also can, for example, exhibit extension of at least approximately 3% under a load of approximately 10 to 30 pounds to facilitate motion of the user.

Figure 7H:
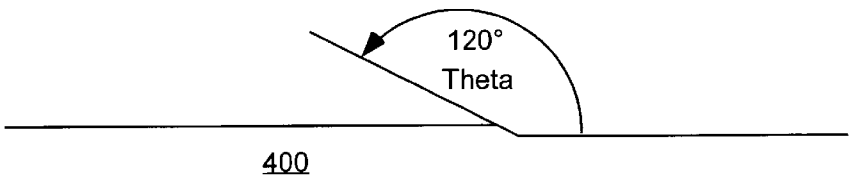
FIG. 7H illustrates an example of a generally blunted angle for a strap portion of the safety harness of the present invention.
Figure 7I:
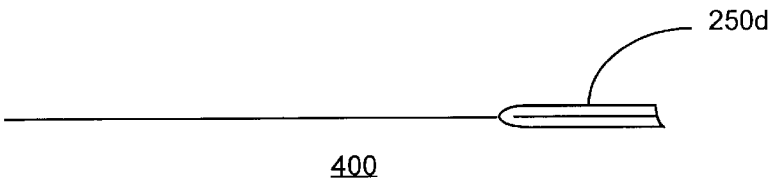
FIG. 7I illustrates a side, cross-sectional view of a tubular strap portion without an inner or filler member therein forming a relatively sharply curved (that is, a curve of a small radius) at the lateral edge thereof.

Although it is difficult to quantify the nature of lateral strap edges that cause discomfort to the user as described above in connection with currently available safety harnesses, generally it is undesirable for the thickness of the strap portion to be less than 0.25 inches. Moreover, sharply angled edges preferably do not come into contact with the user's body. In general, angled edges in contact with the user's body preferably form an angle θ or Theta of no less than approximately 120° as illustrated in FIG. 7H. Even rounded or curved edges that are thin or have a small radius of curvature can cause discomfort. For example, FIG. 7I illustrates outer shell 250*d* without a filler member therein drawn over user's shoulder 400 when under a tension force to form a generally curved edge of a relatively small radius. Preferably, in the case of rounded or curved lateral edges of straps of the present invention, the radius of curvature of such lateral edges (over the area of contact with the user) is at least approximately ⅛ inch. More preferably, the radius of curvature of lateral edges of straps of the present invention (over the area of contact with the user) is at least approximately 3/16 inch.

Figure 7J:
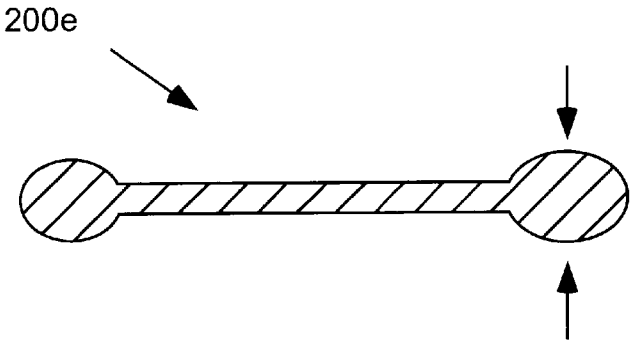
FIG. 7J illustrates a side, cross-sectional view of another embodiment of a strap portion of the present invention.
Figure 7K:
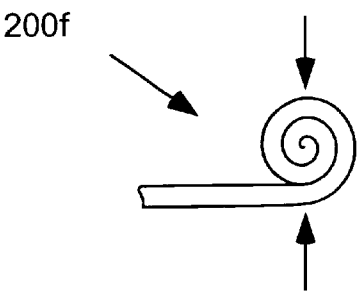
FIG. 7K illustrates a side, cross-sectional view of another embodiment of a strap portion of the present invention.

FIGS. 7J and 7K illustrate other embodiments of strap portions 200*e* and 200*f*, respectively, in which the the strap portions include a single, preferably integral material rather than the outer shell/inner member construction as described above. As described above, at least the lateral edges of strap portions 200*e* and 200*f* have a thickness in a range of approximately 0.25 inches to approximately 0.5 inches. Moreover, the lateral edges of strap portions 200*e* and 200*f* do not form sharp edges as also described above. Likewise, strap portions 200*e* and 200*f* are preferably fabricated from a relatively high-strength material that is preferably suitable to withstand any forces experienced in fall protection. Once again, in the United States, for example, such materials preferably exhibit an ultimate tensile load of at least approximately 4000 pounds, and, more preferably, at least approximately 4500 pounds. Strap portions 200*e* and 200*f* can be fabricated, for example, from a standard webbing material as described above, with modifications to the weave thereof (as within the skill of one skilled in the art of weaving) to provide thickened, blunted lateral edges or with post-weaving processing to provide thickened, blunted lateral edges. Strap portion 200*e* of FIG. 7J, for example, illustrates an example of weaving modification to provide a webbing materials with thickened, blunted lateral edges. FIG. 7k, for example, illustrates an example of post weaving processing (that is, spiraling of lateral edges) to provide a webbing material having thickened, blunted lateral edges.

Figure 8A:
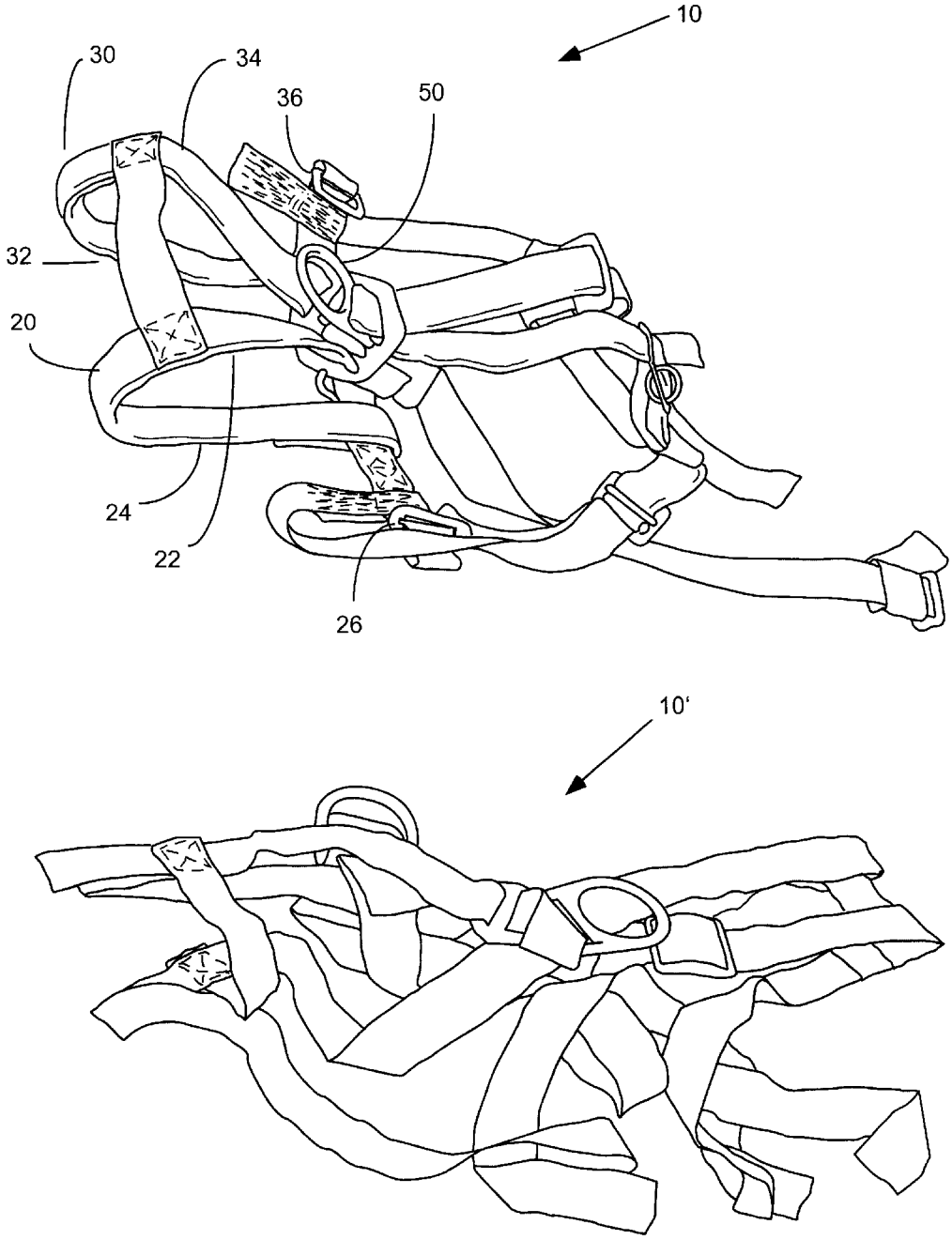
FIG. 8A illustrates a side perspective view of an embodiment of a safety harness of the present invention and a currently available safety harness showing how the safety harness of the present invention generally keeps its form even when not in use, whereas the currently available safety harness does not retain its form and is prone to tangling.
Figure 8B:
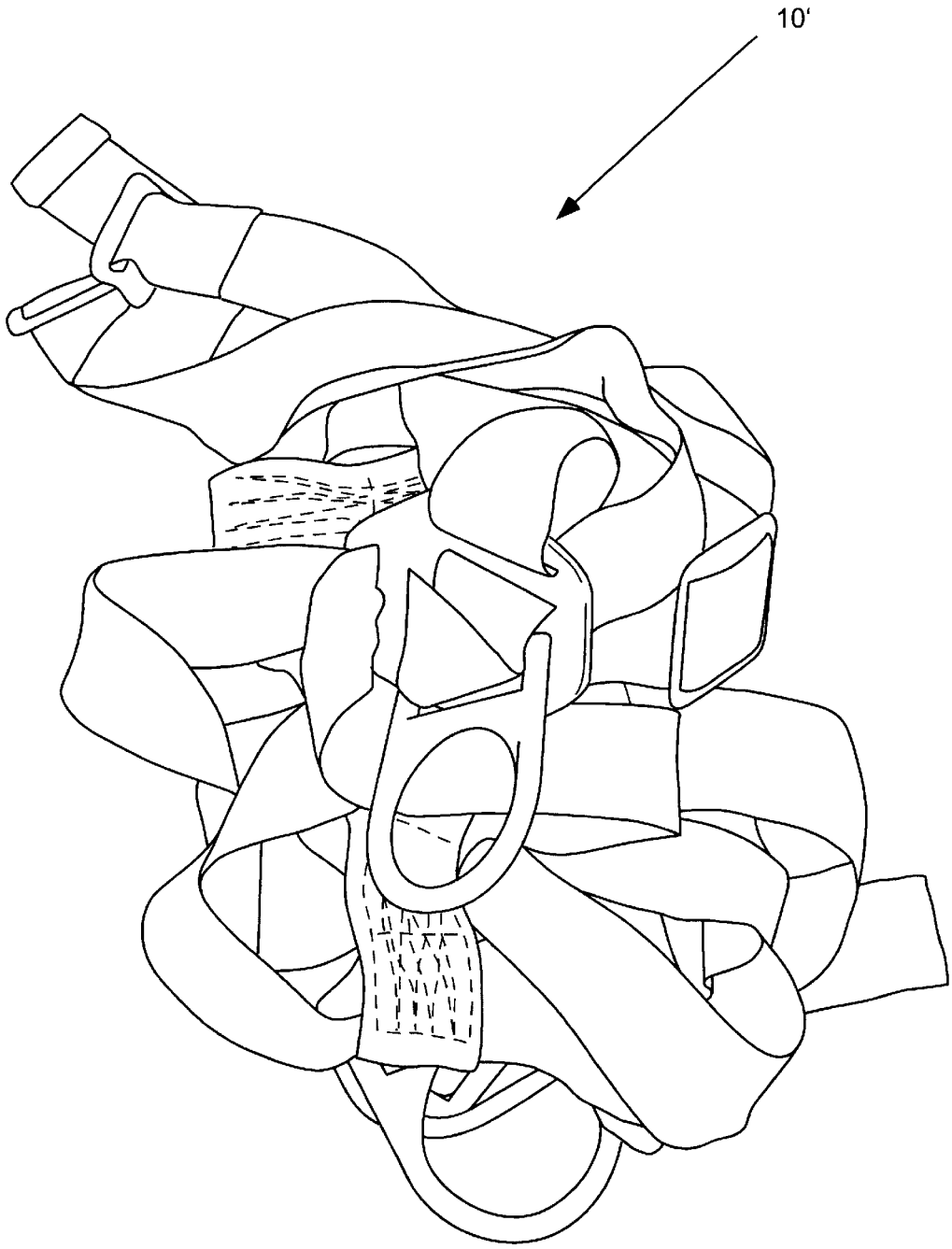
FIG. 8B illustrates the currently available harness of FIG. 8A in a typical, tangled state.

As illustrated, for example, in FIG. 8A, the outer shell and inner or filler member construction of safety harness 10 of the present invention provides advantages beyond improving the comfort of the user. In that regard, inner member 300 also assists in maintaining the shape of safety harness 10 in generally the shape of the harness during use even when safety harness 10 is not in use. In the embodiment of FIG. 8A, shoulder straps 20 and 30, as well as back straps 22 and 32 and front straps 24 and 34 have an outer shell/inner filler construction. In a region wherein, for example, a strap portion such as front strap 24 reaches an attachment mechanism such as buckle 26, the inner filler member can be terminated. A second, currently available harness 10' fabricated from a standard webbing material such as webbing material 2 is also illustrated in FIG. 8A and 8B for comparison. Currently available safety harness 10' does not retain its form and is prone to tangling as best illustrated in FIG. 8B.

In that regard, although inner member of the present invention is preferably compressible, flexible, compliant and bendable as described above, the inner member is also preferably sufficiently "stiff" to generally retain its shape when under relatively low force (for example, under the force of gravity). For example, shoulder straps 20 and 30 preferably generally conform to their in-use shape even when safety harness 10 is not in use. Such "stiffness" helps to prevent the straps of safety harness 10 (for example, shoulder straps 20 and 30) from tangling when not in use. The retention of the shape of safety harness 10 and reduction of the likelihood of tangling also greatly increase the ease with which safety harness 10 of the present invention can be donned by the user. Thus, the flexibility and elasticity of the inner member is preferably such that the inner member does not substantially interfere with motion of the person when the safety harness is in use, but that the strap portion retains its shape when the safety harness is not in use.

Figure 9:
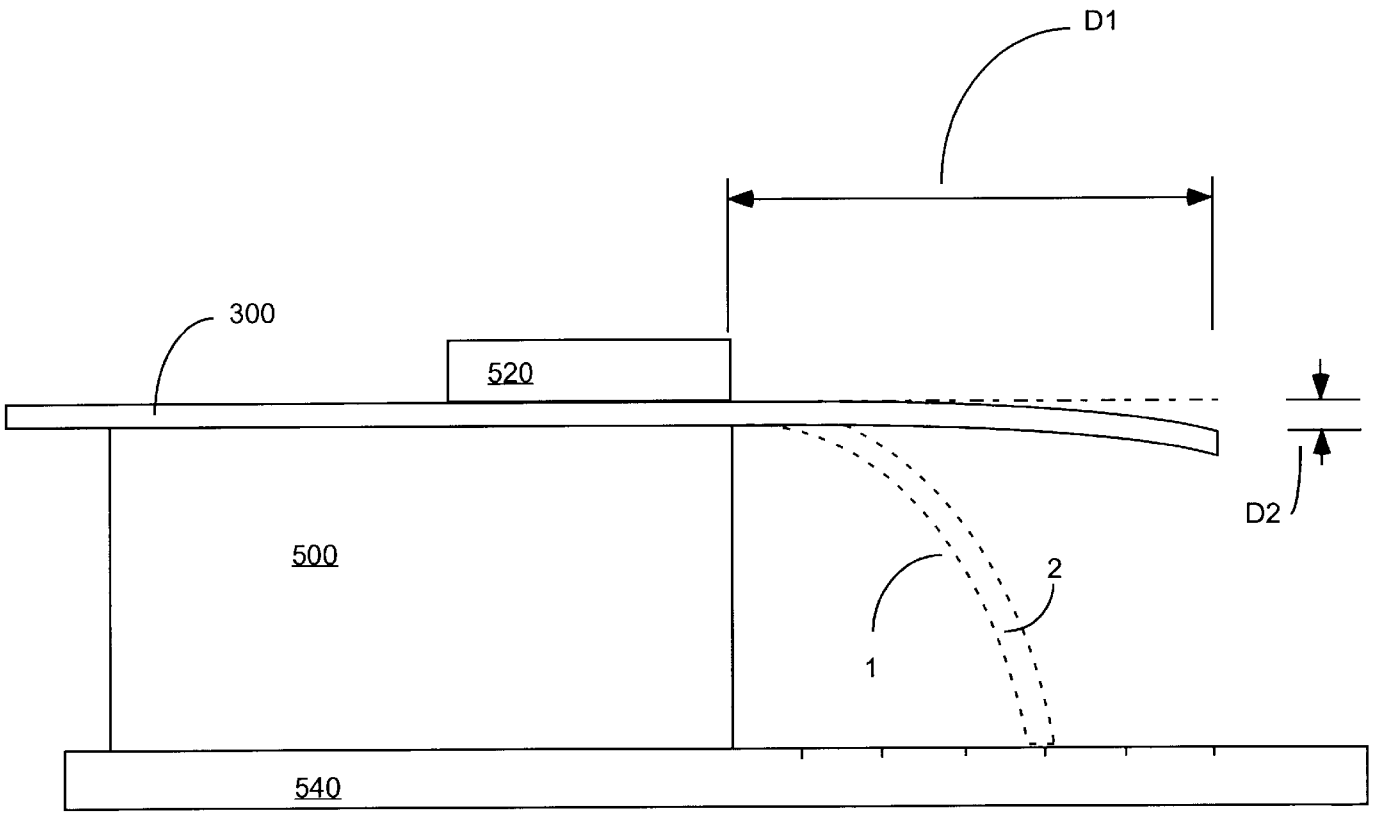
FIG. 9 illustrates a side view of a testing apparatus and method for determining material flexibility/stiffness.
Figure 10:
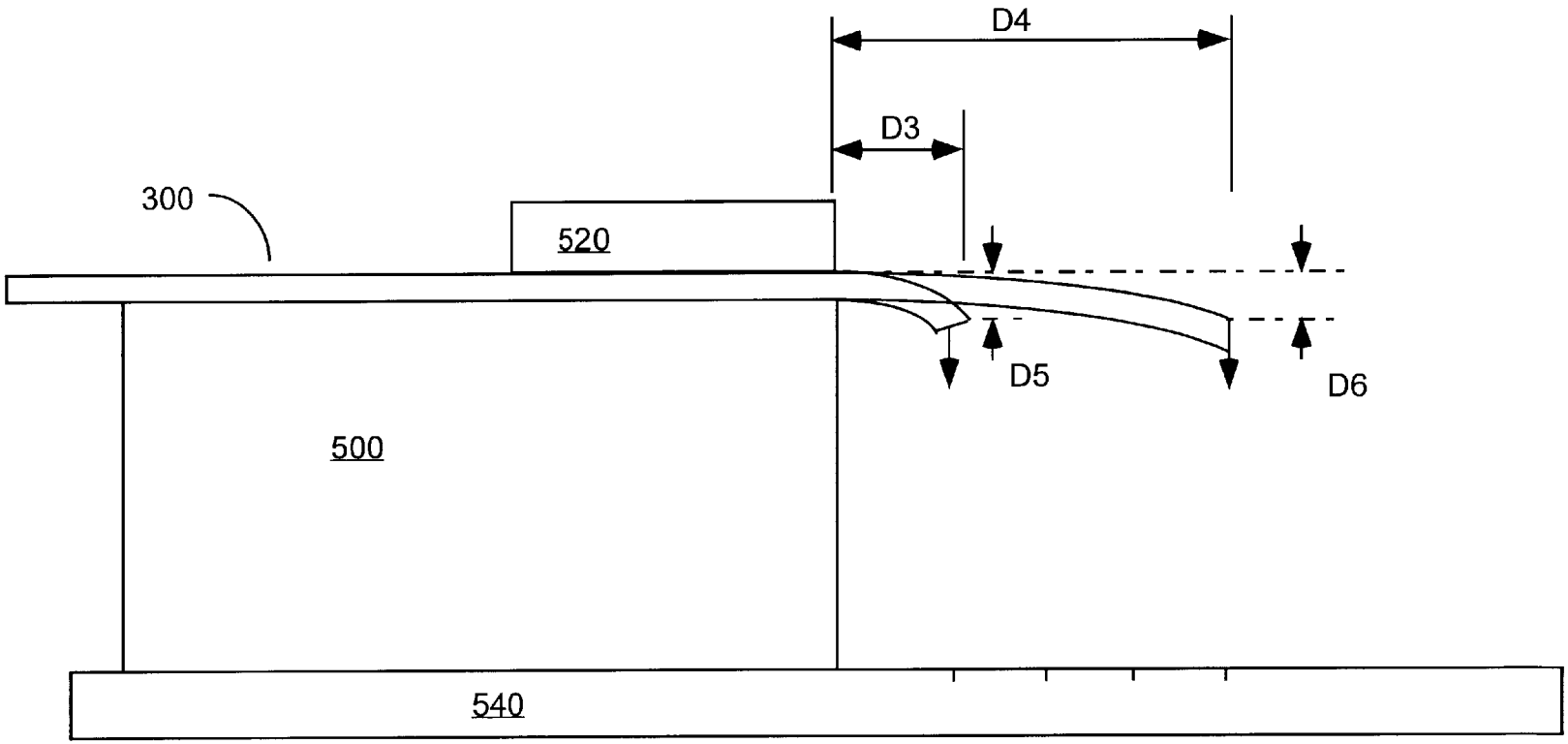
FIG. 10 illustrates the use of the testing apparatus of FIG. 9 in another testing method for determining material flexibility/stiffness.

FIGS. 9 and 10 provide examples of simple and readily executable tests of material stiffness to identify materials suitable for use in the inner members or filler members of the safety harnesses of the present invention. In FIG. 9, a length of filler material 300 having a width suitable for use in the safety harnesses of the present invention is rested upon a fixture block 500. A pressure plate 520 is placed upon the top of filler material 300 so that its leading edge is generally aligned with the leading edge of fixture block 500. Inner member 300 is then advanced forward to extend a first distance D1 that is preferably approximately 6 inches forward of the leading edges of fixture block 500 and pressure plate 520. A ruled measurement block 540 can be used to measure distance D1. Preferably, inner member 300 bends or deflects under its own weight no more than a distance D2, measured as the vertical distance between the top of inner member at the leading edge of fixture block 500 and the top of inner member 300 at distance D1. Preferably, the amount of deflection of distance D2 is no more than approximately 0.75 inches. For comparison, the deflection of a typical webbing material 2 used in currently available safety harnesses is also illustrated in FIG. 9. Preferably, deflection is measured after the system comes to equilibrium (preferably, within approximately 30 seconds).

A second measure or testing method for a suitable range of stiffness for inner member 300 using the apparatus of FIG. 9 is illustrated in FIG. 10. As in the test of FIG. 9, filler material 300 is rested upon fixture block 500. Pressure plate 520 is placed upon the top of filler material 300 so that its leading edge is generally aligned with the leading edge of fixture block 500. During a test, inner member 300 is advanced forward to extend between a distance of D3 and D4 beyond the leading edge of fixture block 500. After extension, a load of approximately 2 ounces is placed upon the leading edge of inner member 300 (attached using any suitable attachment means as know in the art), and the deflection is measured after the system comes to equilibrium (preferably, within approximately 30 seconds). A minimum stiffness can be defined by limiting the amount of deflection of inner member 300 to no more than a distance D5 when extended to distance D3. A maximum stiffness can be defined by limiting the amount of deflection of inner member 300 to no more than a distance D6 when extended to distance D4. D3 is preferably approximately 1 inch and D4 is preferably approximately 4 inches. Preferably, both D5 and D6 are approximately 0.75 inches.

In addition to the material properties described above, the inner of filler members of the present invention preferably do not kink or fold permanently when bent or twisted. Moreover, the material preferably does not absorb water.

The inner or filler members of the present invention can, for example, be formed from a foamed polymeric material such as a foamed polyurethane or a cross-linked polyethylene foam. Such materials exhibit generally the properties discussed above in that they are sufficiently flexible and elastic to allow substantially unfettered movement, yet are sufficiently stiff to retain their shape when not in use. These materials are also of suitable compressibility to prevent sharp edges at the lateral edges of a strap portion under the tension forces experienced in normal use of the safety harnesses of the present invention. Moreover, these materials do not kink and are generally waterproof. An example of a suitable material for the inner or filler members of the present invention is cross linked, polyethylene foam available from Dela, Inc. of Ward Hill, Mass. under the product number 2 lb. XLTE Foam. This cross linked, polyethylene foam has a density of approximately 2–4 lb/ft$^3$.

The inner members or filler members of the present invention need not be integral across the cross section thereof. For example, "intertwined," "tangled" or "bundled" lengths of, for example, polymeric filaments can also be used.

Buckles used in safety harnesses of the present invention can, for example, be fabricated from forged steel or stamped from sheet steel and preferably having a minimum tensile strength of approximately 4,000 lbs. Such buckles are preferably cad or zinc plated and meet the ASTM fifty-hour salt spray test requirements. D-rings for use in safety harnesses of the present invention are preferably steel rings with a minimum tensile strength of approximately 5000 lbs. Such D-rings are preferably cad or zinc plated and meet the ASTM fifty-hour salt spray test requirements. Stitching is preferably performed with a nylon thread such as VT-295E, Type II, Class A sizes 415 and F. Sewing is preferably performed with four to six stitches per inch with size 415 thread and with six to eight stitches per inch with size F thread. All stitching ends are preferably backstitched a minimum of two stitches.

Full-body harnesses under the present invention generally meet or exceed the requirements of all relative OSHA, CSA (Canadian Standards Association) and ANSI standards. Moreover, the benefits received from the of the present invention into safety harnesses are not limited to certain safety harness designs. Virtually any known safety harness design or configuration can be retrofitted or any new safety harness be designed to incorporate such elastic materials.

Although the present invention has been described in detail in connection with the above examples, it is to be understood that such detail is solely for that purpose and that variations can be made by those skilled in the art without departing from the spirit of the invention except as it may be limited by the following claims.

What is claimed is:

1. A safety harness to be worn by a person, the safety harness comprising: a strap portion for extending over a portion of the person's body to retain the person within the safety harness, at least a section of the strap portion including an outer shell of a high strength, flexible material suitable to withstand forces experienced in a fall, the outer shell having a channel therein, the strap portion further including a flexible inner member within the channel of the outer shell.

2. The safety harness of claim wherein the flexibility of the inner member is limited such that the inner member retains its shape sufficiently to prevent tangling of the strap portion when not in use.

3. The safety harness of claim 1 wherein the inner member is elastic and the length of the tubular outer shell is sufficiently long to allow extension of the strap portion.

4. The safety harness of claim 3 wherein the material of the outer shell has an ultimate tensile strength of at least 4000 pounds.

5. The safety harness of claim 1 wherein the inner member is elastic and the outer member is fabricated from a high strength, elastic material.

6. The safety harness of claim 5 wherein the material of the outer shell has an ultimate tensile strength of at least 4000 pounds and exhibits an elastic extension of at least approximately 3% under a tensile load of approximately 20 pounds.

7. The safety harness of claim 1 wherein the inner member is compressible.

8. The safety harness of claim 1 wherein the inner member exhibits a compression of approximately 25% at an applied pressure in the range of approximately 4 to approximately 10 $lb/in^2$.

9. The safety harness of claim 1 wherein the inner member exhibits a compression of approximately 50% at an applied pressure in the range of approximately 8 to approximately 20 $lb/in^2$.

10. The safety harness of claim 1 wherein the inner member maintains a thickness of the strap portion in the region of the lateral edges thereof of at least approximately 0.25 inches when under tension forces experienced in normal use of the safety harness.

11. The safety harness of claim 1 wherein a minimum stiffness for the material of the inner member is defined such that the inner member deflects no more than approximately 0.75 inches when extended over an edge to a distance of approximately 1 inch past the edge and placed under a load of approximately 2 ounces.

12. The safety harness of claim 1 wherein a maximum stiffness for the material of the inner member is defined such that the inner member deflects no more than approximately 0.75 inches when extended over an edge to a distance of approximately 4 inch past the edge and placed under a load of approximately 2 ounces.

13. A safety harness to be worn by a person, the safety harness comprising: a strap portion for extending over a portion of the person's body to retain the person within the safety harness, at least a section of the strap portion including an outer shell of a high strength, flexible material suitable to withstand forces experienced in a fall and a flexible inner member, the flexibility of the inner member being such that the inner member does not substantially interfere with motion of the person when the safety harness is in use but that the strap portion generally retains its shape when the safety harness is not in use.

14. The safety harness of claim 13 wherein the inner member is elastic and the length of the tubular outer shell is sufficiently long to allow extension of the strap portion.

15. The safety harness of claim 14 wherein the material of the outer shell has an ultimate tensile strength of at least 4000 pounds.

16. The safety harness of claim 13 wherein the inner member is elastic and the outer member is fabricated from a high strength, elastic material.

17. The safety harness of claim 14 wherein the material of the outer shell has an ultimate tensile strength of at least 4000 pounds.

18. The safety harness of claim 13 wherein the inner member is compressible.

19. The safety harness of claim 13 wherein the inner member exhibits a compression of approximately 25% at an applied pressure in the range of approximately 4 to approximately 10 $lb/in^2$.

20. The safety harness of claim 13 wherein the inner member exhibits a compression of approximately 50% at an applied pressure in the range of approximately 8 to approximately 20 $lb/in^2$.

21. The safety harness of claim 13 wherein a minimum stiffness for the material of the inner member is defined such that the inner member deflects no more than approximately 0.75 inches when extended over an edge to a distance of approximately 1 inch past the edge and placed under a load of approximately 2 ounces.

22. The safety harness of claim 13 wherein a maximum stiffness for the material of the inner member is defined such that the inner member deflects no more than approximately 0.75 inches when extended over an edge to a distance of approximately 4 inch past the edge and placed under a load of approximately 2 ounces.

23. A method of manufacturing a strap for a safety harness for extending over a portion of the person's body to retain the person within the safety harness, the method comprising the step of placing a flexible inner member within an inner channel of an outer shell of a high strength, flexible material suitable to withstand forces experienced in a fall, the flexible inner member generally preventing the lateral edges of the strap portion from forming an edge when under tension, the flexibility of the inner member being such that the inner member does not substantially interfere with motion of the person when the safety harness is in use but that the strap portion generally retains its shape when the safety harness is not in use.

* * * * *